US008297529B2

(12) United States Patent
Smith et al.

(10) Patent No.: US 8,297,529 B2
(45) Date of Patent: Oct. 30, 2012

(54) DIRECTIONAL JET FLOW CONTROL

(75) Inventors: Barton L. Smith, Logan, UT (US); Ryan Smith, Mountain Green, UT (US)

(73) Assignee: Utah State University, Logan, UT (US)

( * ) Notice: Subject to any disclaimer, the term of this patent is extended or adjusted under 35 U.S.C. 154(b) by 220 days.

(21) Appl. No.: 12/435,007

(22) Filed: May 4, 2009

(65) Prior Publication Data

US 2009/0230209 A1 Sep. 17, 2009

Related U.S. Application Data

(63) Continuation-in-part of application No. 11/637,443, filed on Dec. 11, 2006, now Pat. No. 7,757,966.

(60) Provisional application No. 60/749,202, filed on Dec. 9, 2005.

(51) Int. Cl.

| | |
|---|---|
| ***B05B 17/04*** | (2006.01) |
| ***B05B 7/06*** | (2006.01) |
| ***B05B 7/04*** | (2006.01) |
| ***F23D 11/16*** | (2006.01) |
| ***F23D 11/10*** | (2006.01) |

(52) U.S. Cl. ..... 239/11; 239/420; 239/423; 239/424; 239/433; 239/DIG. 7

(58) Field of Classification Search ..... 239/11, 239/79, 225.1, 231, 232, 233, 244, 245, 247, 239/263.3, 264, 398, 399, 402.5, 403, 405, 239/406, 408, 416.4, 416.5, 420, 421, 423, 239/424, 432, 433, 434.5, DIG. 7
See application file for complete search history.

(56) References Cited

U.S. PATENT DOCUMENTS

| | | | | | |
|---|---|---|---|---|---|
| 4,439,137 | A * | 3/1984 | Suzuki et al. | ..... | 431/8 |
| 4,475,885 | A * | 10/1984 | Finke | ..... | 431/182 |
| 4,622,007 | A * | 11/1986 | Gitman | ..... | 432/13 |
| 5,554,022 | A * | 9/1996 | Nabors et al. | ..... | 431/10 |
| 5,882,184 | A * | 3/1999 | Feldermann | ..... | 431/9 |
| 7,175,423 | B1 * | 2/2007 | Pisano et al. | ..... | 431/10 |

* cited by examiner

*Primary Examiner* — Len Tran
*Assistant Examiner* — Ryan Reis

(57) ABSTRACT

A device is disclosed that uses a flow-control methodology to control sprays at very high precision and frequency. The device is based on an enhanced Coanda effect. The control flow is selectively applied to the region in which we desire the jet to vector and control the profile (width) of the jet. The control flow is introduced through multiple control flow ports surrounding the primary nozzle and adjacent to the Coanda surface. By selectively opening and closing different control flow ports the motion and profile of the jet can be controlled.

20 Claims, 4 Drawing Sheets

Two dimensional representation of the directional jet flow control device showing a control flow through one control port vectoring the primary jet to one side.

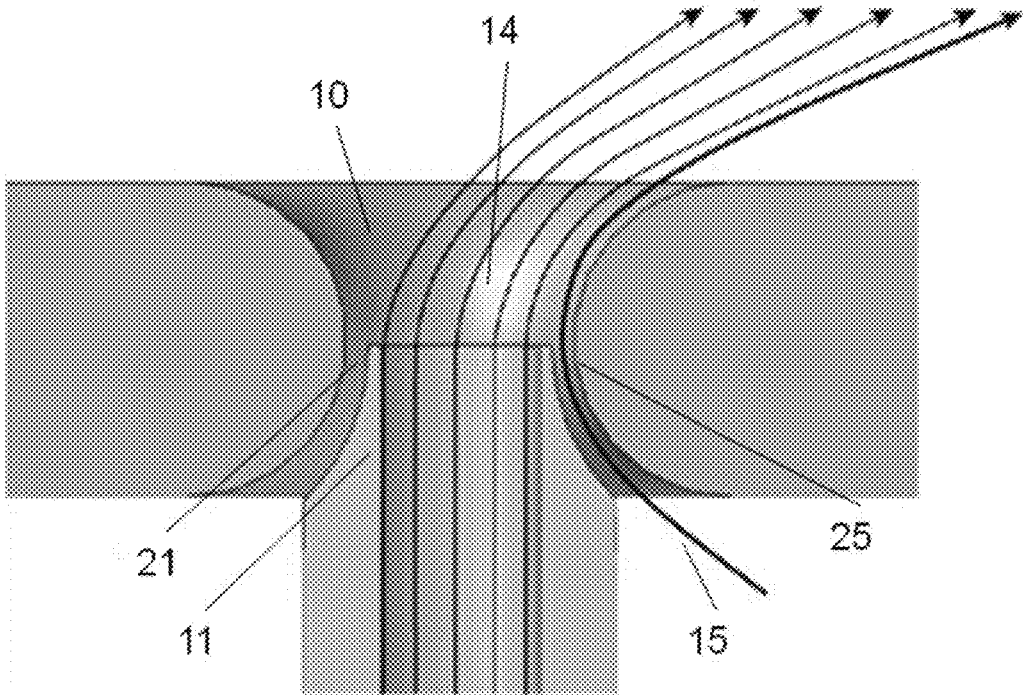
Figure 1. Two dimensional representation of the directional jet flow control device showing a control flow through one control port vectoring the primary jet to one side.

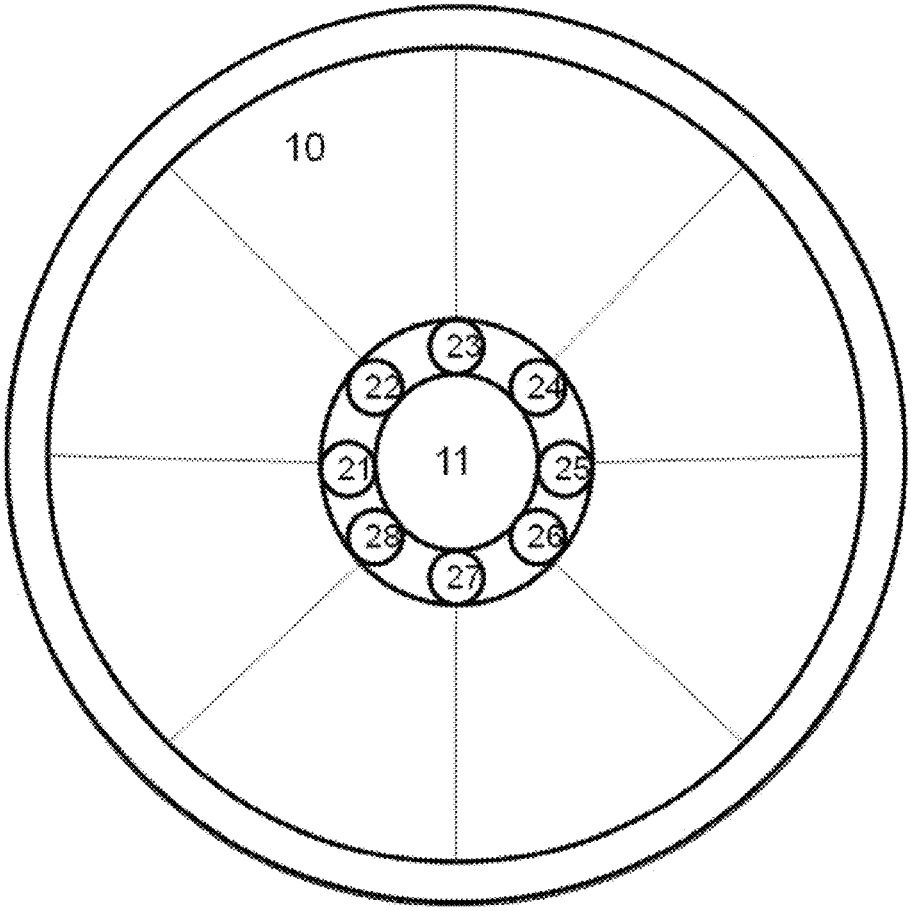
Figure 2. A view looking into the jet flow control device showing the primary nozzle in the center surrounded by control flow ports adjacent to the coanda surface.

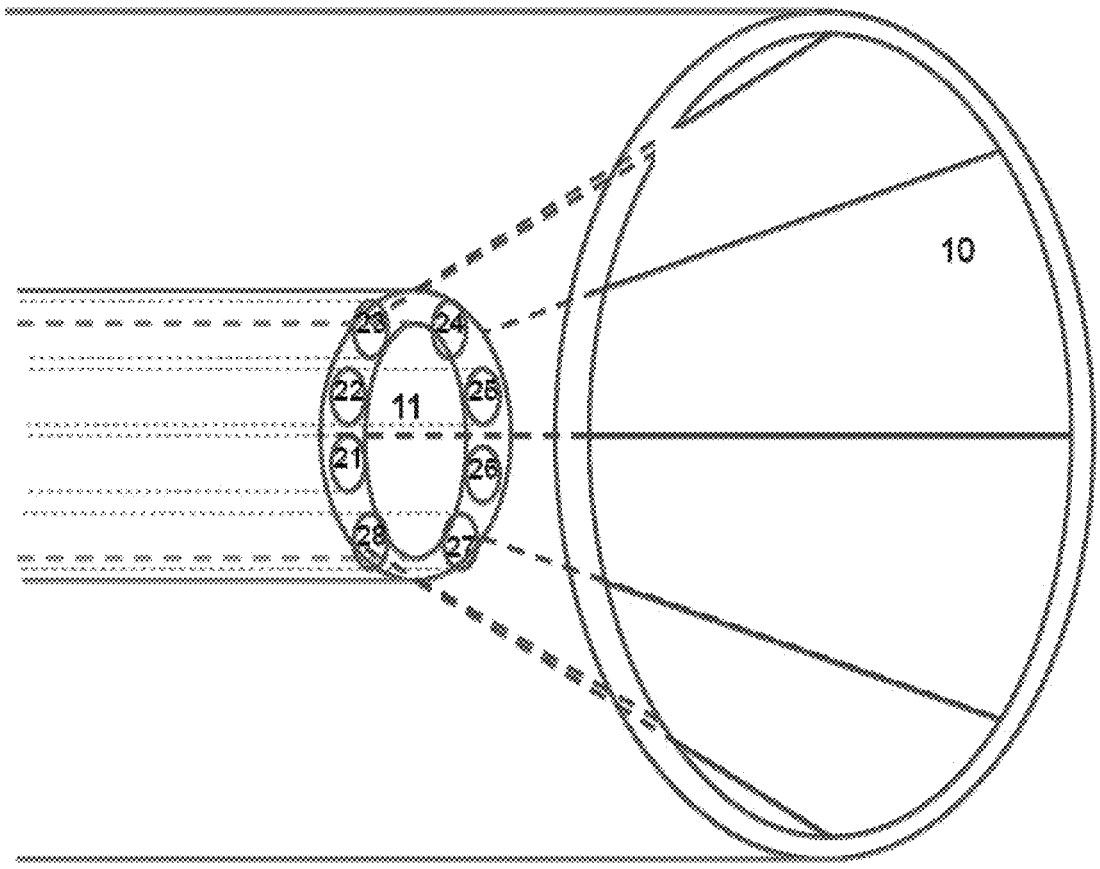
Figure 3. Schematic of the directional flow control device.

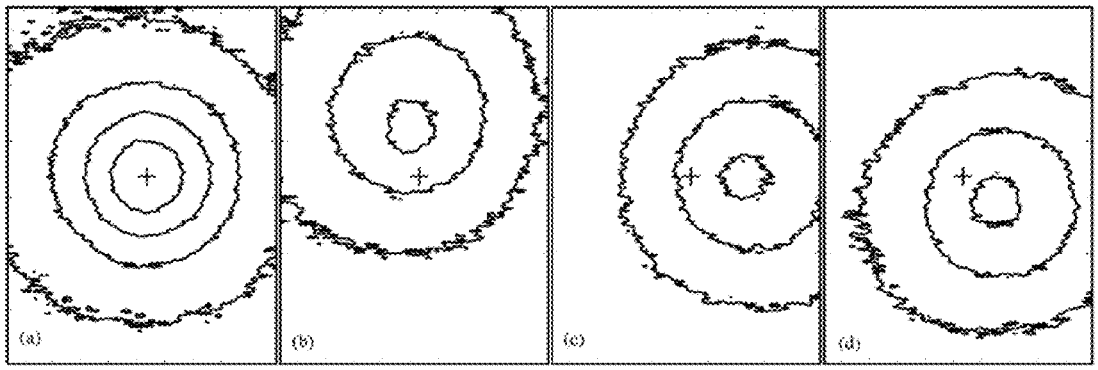
Figure 4. Jet pattern from the directional flow control device with a) zero control flow, b) the control flow from the upper left, c) the control flow from the right, and d) the control flow from the lower right.

DIRECTIONAL JET FLOW CONTROL

RELATED APPLICATIONS

This application is a Continuation-in-part of U.S. patent application Ser. No. 11/637,443 filed on Dec. 11, 2006, entitled "High-Speed Jet Control" which claims priority to U.S. Provisional Application No. 60/749,202 filed on Dec. 9, 2005, entitled "High-Speed Jet Control", both of which are incorporated herein by reference.

TECHNICAL FIELD

The present invention relates to methods and devices for directing and controlling high-speed fluid jets and thermal sprays.

BACKGROUND

There are many processes that can benefit from the ability to precisely vector a jet and to control its width. These include thin-film coating processes in which it is vitally important that the film thickness be uniform, even if the surface to be coated is not flat. In many of these processes, such as thermal sprays, the contents of the jet or spray are combusting, making the environment in which the jet operates very hostile. Control schemes that rely on vectoring of the jet nozzle would place moving parts in this hostile environment, where they would wear quickly, and be severely limited in slew rate. Multiple nozzles can be used to cover a large area, but they (or the coated surface) must be traversed. Additionally, it is difficult to coat evenly in this manner.

The most fundamental method of changing the direction and shape of a jet is by modifying the direction and shape of the nozzle from which it emanates. The hardware required to effect these changes is unreliable and heavy and thus slow.

More elegant methods include the use of secondary flows to modify the jet. One method is to use oscillatory blowing to vector a planar jet. A high slew rate is one of the primary advantages to this method. However, it is difficult to reliably generate the required oscillatory blowing. Another method uses a combination of blowing and suction through adjacent slots to achieve a similar effect. Suction combined with a Coanda surface has been shown to be effective for vectoring a compressible jet flow. Schemes involving suction prohibit use in hostile environments such as combustion since hot and/or corrosive gas would be drawn into the suction slot.

There is considerable need for a nozzle that can be built over a large range of scales, operate in a hostile environment, and position a jet or aerosol precisely and at high slew rate.

Many industrial spray processes can benefit from precise direction and profile control. thermal spray processing is an established industrial method for applying "thick coatings" of metals (stainless steel, cast iron, aluminum, titanium and copper alloys, niobium and zirconium) and metal blends, ceramics, polymers, and even bio-materials at thicknesses greater than 50 micrometers. Several different processes, including Combustion Wire Thermal Spray, Combustion Powder Thermal Spray, Arc Wire Thermal Spray, Plasma Thermal Spray, HVOF Thermal Spray, Detonation Thermal Spray, and Cold Spray Coating can benefit from the ability to alter the direction of the spray. Currently, expensive robots are commonly used for this purpose. Thermal spray coatings are used for corrosion and erosion prevention, chemical or thermal barrier and wear protection, and general metalizing on applications ranging from aircraft engines and automotive parts to medical implants and electronics. The process involves spraying molten powder or wire feedstock onto a prepared surface (usually metallic) where impaction and solidification occur. Melting typically occurs through oxy-fuel combustion in the nozzle or an electric arc (plasma spray) located just downstream of the nozzle structure. Thermal spray processes typically result in very high material cooling rates (>106 K/s). Similarly, Flame Spray Pyrolysis (FSP), a process to synthesize metal and mixed metal oxide nanoparticles, uses a flame as an energy source to produce intraparticle chemical reactions and convert liquid sprayed reagents to the final product. Due to the high temperature combustion environment present in or near these process nozzles, mechanical vectoring of the nozzle is not feasible since this would place moving parts in the jet flow, reduce device durability, and severely limit directional frequency response. Furthermore, traversing a part to be coated, which is often heated to high temperatures, is costly.

Films are deposited on surfaces (substrate) using a variety of thermal spay processes, depending on the material to be deposited and the surface on which it is to be applied. The processes generally belong to one of three categories: flame spray, electric arc spray, and plasma arc spray. The nozzles of modern thermal spray devices are designed to create the desired process and are generally not directional. Coating of large surfaces is achieved by traversing the spray gun, sometimes with a dedicated robot.

In many flame processes, as little as 10% of the flame energy is used to melt the feedstock. This results in excessive heating of the substrate. The time that the coating material resides in the flame, termed residence time, is critical to many characteristics of the coating, including porosity and oxidation. Porosity of the coating is very important and is a function of many parameters of the process, including particle speed, size distribution and spray distance. Molten material that is not sufficiently heated may result in higher porosity, as can sprays applied at a large angle relative to the surface. In many applications, it is desirable to have low porosity, while in others, higher porosity may be beneficial (e.g. tribological applications and biomedical implants). Thus, a robust and simple method to control porosity is beneficial.

One method of changing the direction and shape of a jet is by modifying the direction and shape of the nozzle from which it flows. This is currently being investigated as a method for thrust-vectoring of fighter aircraft, although the hardware required to effect these changes is unreliable and heavy (and thus slow). More elegant methods include the use of secondary flows to modify the jet. High frequency response is one of the primary advantages of this method. However, it is difficult to reliably generate the required oscillatory blowing. Suction combined with a Coanda surface has been shown to be effective for vectoring a compressible jet flow. Unfortunately, schemes involving suction prohibit use in hostile environments such as combustion since hot and/or corrosive gas would be drawn into the suction slot.

SUMMARY OF THE INVENTION

A new device is disclosed that uses a flow-control methodology to control the direction and profile of high-speed jets or sprays at very high precision and frequency. The device is based on an enhanced Coanda effect. The device makes it possible to control flow in harsh environments and to apply thin films to very large surface areas with a single nozzle, and to do so to a precisely desired thickness.

This device makes use of an enhanced Coanda effect, termed Coanda assisted Spray Manipulation (CSM), to vector and control the profile (width) of the jet. The Coanda effect, or the tendency of jets to adhere to nearby surfaces, is a well established flow-control methodology. Flow-control is achieved by adding a blowing control flow to enhance profile and direction control and improve the stability of the jet or spray. This device makes it possible to apply films on large surfaces at precisely controllable thicknesses with a single nozzle and no moving parts in or near the jet flow (where corrosive materials, combustion and/or high temperatures may be present). As such, the new device will enable long-term operation of controllable jets or sprays in harsh, corrosive, and combusting environments.

The primary jet flow passes through the center of the nozzle. The control flow is introduced through one or more ports positioned circumferentially around the primary flow. The flow through each control port is turned on or off individually by a set of valves, thus the circumferential position of the control flow can be adjusted by opening and closing one or more valves. When a control port is open, the control flow attaches to the nozzle surface in that region and vectors the primary jet in that direction. By closing a control port and opening a control port in another circumferential location, the direction of the primary jet is changed and is now vectored in the direction of the open control port. The jet then vectors toward the control flow at an angle that increases with the momentum (the square of the velocity times density times area) of the control flow.

CSM can improve thermal spray processes by rapidly orbiting the flame at rates above the response time of the particulate material. By orbiting the flame, the intense heating of the substrate that is typical of thermal sprays is mitigated. The heat is spread to a much larger area resulting in lower temperatures.

DESCRIPTION OF THE FIGURES

Understanding that drawings depict only certain preferred embodiments of the invention and are therefore not to be considered limiting of its scope, the preferred embodiments will be described and explained with additional specificity and detail through the use of the accompanying drawings.

FIG. 1. Two dimensional representation of the directional jet flow control device showing a control flow through one control port vectoring the primary jet to one side.

FIG. 2. A view looking into the jet flow control device showing the primary nozzle in the center surrounded by control flow ports adjacent to the coanda surface.

FIG. 3. Schematic of the directional flow control device.

FIG. 4*a*. Jet pattern from the directional flow control device with zero control flow.

FIG. 4*b-d*. Jet pattern from the directional flow control device with control flow from various control flow ports.

DETAILED DESCRIPTION OF THE INVENTION

In the following description, numerous specific details are provided for a thorough understanding of specific preferred embodiments. However, those skilled in the art will recognize that embodiments can be practiced without one or more of the specific details, or with other methods, components, materials, etc. In some cases, well-known structures, materials, or operations are not shown or described in detail in order to avoid obscuring aspects of the preferred embodiments. Furthermore, the described features, structures, or characteristics may be combined in any suitable manner in a variety of alternative embodiments. Thus, the following more detailed description of the embodiments of the present invention, as represented in the drawings, is not intended to limit the scope of the invention, but is merely representative of the various embodiments of the invention.

This disclosure presents a new directional jet flow control device that utilizes an adjustable flow-control methodology to control the direction and geometry of sprays or fluid jets emanating from a nozzle. The device is based on the Coanda effect, also known as "boundary-layer attachment" and is the tendency for a stream of fluid to remain in contact with, or attached to, a convex surface, rather than following a straight path in its original direction. The convex surface is herein referred to as the Coanda surface. The Coanda effect results from the reduced pressure on the inside of the turning radius. This competes with the dissipation of the boundary-layer energy until the flow detaches from the surface. The fluid is simply turned and nominally retains its original cross-section dimension. The Coanda effect is often bi-stable, meaning the flow may be completely attached or completely separated depending on the initial conditions, or even unstable, resulting in undesirable flapping of the flow.

Boundary-layer separation, such as the separation of the fluid from the surface is suppressed by blowing a secondary fluid through a slot or orifice in line with the primary flow. By blowing a secondary fluid in the region where the jet meets the Coanda surface, the Coanda effect can be controlled and enhanced. The addition of a secondary flow makes it possible to turn the fluid over a much smaller radius compared to the same flow conditions without the secondary flow. By changing the speed of the secondary flow, the angle to which the fluid is vectored can then be controlled. Vectoring is defined as the change in angle from the original flow direction to the direction at which the fluid is moving when it detaches from the Coanda surface.

The change in direction of the control flow induces the primary flow to also follow the same pattern as the control flow. The surface contour acts to define how the control flow is going to pull the primary flow. In addition to the contour of the Coanda surface, to control the details of the direction and profile of the resulting fluid jet, the degree of blowing velocity of the control flow and the velocity of the primary flow are controlled.

The disclosed directional jet flow control device, also referred to as a Coanda-assisted Spray Manipulation (CSM) device, utilizes the Coanda Effect, enhanced with a secondary blowing control flow to control the direction and geometry of a high speed jet. This device provides the advantages of high-reliability, high-directional frequency response, and usefulness in hostile environments because there is no suction flow or moving parts in the jet flow. The jet is defined as the fluid flow through the fluid flow channel which is referred to as the primary flow through the nozzle. The primary flow can be a high speed fluid, such as a gas or liquid, and in thermal spray applications it is the effluent exiting the nozzle.

If the Coanda surface circumferentially surrounds the jet, it is also possible to expand or spread the jet flow. An axisymmetric jet with a thin, annular control flow completely surrounding the jet, and applied in line with the jet can cause the jet flow to attach to the exit plane in every circumferential direction, resulting in an extreme expansion of the jet flow. The disclosed invention is a directional jet flow control device with a geometry such that the control flow is selectively applied to the region in which it is desired to turn or vector the jet rather than a flow applied completely surrounding the jet.

FIG. 1 shows a representation of the disclosed invention. In this embodiment the Coanda surface 10 is a smooth, continuous convex surface that circumferentially surrounds the fluid flow channel 11. There are multiple control flow channels circumferentially surrounding the fluid flow channel 11 and located between the fluid flow channel 11 and the Coanda surface 10. Two of these control flow channels 21, 25 are visible in FIG. 1. FIG. 2 is a view looking into the Coanda-assisted Spray Manipulation device. From this view, eight control flow channels 21, 22, 23, 24, 25, 26, 27, 28 can be seen surrounding the fluid flow channel 11 and positioned to introduce flow along the Coanda surface 10. The operation of the directional jet flow control device can be visualized by referring back to FIG. 1. The jet, or primary flow 14 exits the fluid flow channel 11 and would normally flow straight. When a control flow 15 is introduced at a desired circumferential location, such as through control flow channel 25, it attaches to the Coanda surface 10 and follows the curvature. This creates a low pressure region that draws the jet toward the control flow 15 along the Coanda surface 10 resulting in vectoring of the jet 14 to one side.

The control flow through the various control flow channels is used to adjust the vectoring of the primary flow. FIG. 3 shows eight control flow channels 21, 22, 23, 24, 25, 26, 27, 28 surrounding the fluid flow channel 11 and adjacent to the Coanda surface 10, although any number of control flow channels can be used in the directional jet flow control device. The flow through the control flow channels is independently controlled by pneumatic valves or other methods known to those skilled in the art. The commands to turn the valves on and off originate from a computer or other automated system so the switching can occur rapidly and with precise timing. One or more valves to the individual control flow channels can be open simultaneously. This ability to rapidly and precisely start and stop the control flow allows for tremendous flexibility in vectoring and adjusting the geometry of the jet.

The process for vectoring the jet can be shown with reference to FIGS. 3 and 4. FIG. 3 is a representation of the directional flow control device with the fluid flow channel 11 surrounded by eight control flow channels 21, 22, 23, 24, 25, 26, 27, 28 which are adjacent to the Coanda surface 10. FIG. 4*a* shows the jet flow from the fluid flow channel to be symmetrical around the center point in the absence of any control flow. When the control flow is applied at a desired circumferential location, such as through control flow channels 22 and 23, the jet is vectored in the direction of the control flow. This is shown in FIG. 4*b* by the jet flow being off center and vectoring to the upper left region of the figure. Stopping the control flow from control flow channels 22 and 23, and providing control flow through control flow channels 25 and 26 now results in the jet vectoring to the right as shown in FIG. 4*c*. With control flow channels 26 and 27 open, the jet, as shown in FIG. 4*d*, is directed to the lower right region. The position of the control flow determines the circumferential vectoring location, and the velocity of the control flow determines the angle, or magnitude of vectoring.

The disclosed directional jet flow device can be employed to create numerous degrees of jet vectoring and jet profiles. For example, the jet can be rotated by continually vectoring the jet around the circumference of the fluid flow channel 11. This is accomplished by first passing a control flow through control flow channel 21. Control flow channel 22 is then opened at the same time control flow channel 21 is closed. The next step is to open control flow channel 23 and close control flow channel 22. Control flow channel 24 is then opened as control flow channel 23 is closed. Control flow channel 25 is then opened as control flow channel 24 is closed. Control flow channel 26 is then opened as control flow channel 25 is closed. Control flow channel 27 is then opened as control flow channel 26 is closed. Control flow channel 28 is then opened as control flow channel 27 is closed. This sequence of opening and closing the next control flow channel, one at a time in sequence around the circumference of the fluid flow channel causes the jet to vector and rotate. The sequence is repeated to produce a continually precessing or rotating flow.

The rotating jet profile can be spread by opening more than one control flow channel. For example, control flow channel 21, 22, and 23 can be open to vector the jet in that direction. Control flow channel 24 is then opened at the same time control flow channel 21 is closed. The next step is to open control flow channel 25 and close control flow channel 22. Control flow channel 26 is then opened as control flow channel 23 is closed. This sequence is continued around the circumference of the directional flow control device. The steps of opening and closing the next control flow channel, one at a time in sequence around the circumference of the fluid flow channel causes the jet to vector and presess, but since more than one control flow channel is open simultaneously, the vectored jet is spread compared to the embodiment in which only one control flow channel at a time is open. It is obvious to one skilled in the art that multiple jet rotation rates and profiles can be obtained by controlling how many control flow channels are open simultaneously and the amount of time each control flow channel is open. The circumferential position of the control flow determines the vectoring direction. The ratio of the flow rate of the jet through the fluid flow channel to the control flow rate through the control flow channels determines the angle, or magnitude of the vectoring. The curvature of the Coanda surface also influences the magnitude of vectoring.

Other types of jet motion can be controlled by the directional jet flow control device. For example, rather than having the control flow channels open sequentially around the circumference to create the rotating or precessing jet, a side to side or back and forth profile can be obtained. This can be accomplished, with reference to FIG. 3, by first passing a control flow through control flow channel 21. Control flow channel 22 is then opened at the same time control flow channel 21 is closed. The next step is to open control flow channel 23 and close control flow channel 22. Control flow channel 24 is then opened as control flow channel 23 is closed. Rather than continuing around the circumference, the sequence is reversed to create the back and forth jet movement. To accomplish this control flow channel 23 is opened as control flow channel 24 is closed and then control flow channel 22 is opened as control flow channel 23 is closed. The next step is to open control flow channel 21 as control flow channel 22 is closed. The sequence is repeated to create a back and forth or wiping motion of the vectored jet. As in previous examples, more than one control flow channel can be open at one time and the timing for opening and closing the control flow channels determines the rate of side to side vectoring. This back and forth motion can be controlled to cover any angular portion of the entire circumference.

The jet profile can be elongated by opening control flow channels on opposite side of the fluid flow channel. For example, a horizontally elongated jet can be obtained on opening control flow channels 21 and 25 at the same time. This elongated jet can be rotated by opening control flow channel 22 and 26 while closing control flow channel 21 and 25. The next step is to open control flow channel 23 and 27 as control flow channel 22 and 26 are closed. This sequence continues to produce a rotating elongated jet. The jet profile can be changed by opening additional sets of opposing control flow channels and the back and forth motion can be created as described above.

The disclosed invention can be practiced with any number of control flow channels and a variety of control flow channels open or sequencing in various patterns. The Coanda surface contours, radii, and dimensions can be varied for different particular applications. Different control flow velocities and jet velocities can be used to obtain the desired vectoring and flow profile characteristics.

Additional methods to control the delivery location and intensity of a fluid flow are known by those skilled in the art and are equivalents to the flow control methods described. The above descriptions of flow control methods, including preferred embodiments, are to be construed as merely illustrative and not a limitation of the scope of the present invention in any way. It will be obvious to those having skill in the art that many changes may be made to the details of the above-described embodiments without departing from the underlying principles of the invention. It will be appreciated that the methods mentioned or discussed herein are merely examples of means for performing flow control and it should be appreciated that any means for performing flow control which performs functions the same as, or equivalent to, those disclosed herein are intended to fall within the scope of a means for flow control, including those means or methods for flow control which may become available in the future.

What is claimed is:

1. A directionally adjustable jet control device comprising:

a fluid flow channel having an input end and an output end;

multiple control flow channels, located circumferentially around, and adjacent to the fluid flow channel, each control flow channel having an input end and an output end;

a means to independently modulate flow in each individual control flow channel; and a continuous expanding surface beginning immediately next to said output ends of each control flow channel;

wherein said output end of said fluid flow channel merges with said output end of each control flow channel at the beginning of said continuous expanding surface such that when flow is present in a control flow channel, flow from said fluid flow channel is pulled towards the flow exiting the control flow channel.

2. A method to directionally control a jet flow comprising:

a fluid flow channel having an input end and an output end;

a jet flowing through said fluid flow channel;

multiple control flow channels, located circumferentially around, equidistantly spaced, and adjoining said fluid flow channel, and each having an input end and an output end;

a continuous expanding surface beginning immediately next to said output ends of each control flow channel;

said output end of said flow channel merging with said output ends of each control flow channel at the beginning of said continuous expanding surface;

a means to independently modulate flow in each individual said control flow channel; and a control flow through at least one said control flow channel on the side of a desired vectoring direction such that said control flow pulls said jet flow towards the side said control flow is on.

3. The directionally adjustable jet control device of claim 1 wherein said fluid flow channel output end and said multiple control flow channel output ends are coplanar.

4. The device of claim 1, wherein said continuous expanding surface comprises a Coanda surface.

5. The device of claim 1, wherein said continuous expanding surface comprises a convex surface.

6. The device of claim 1, wherein said continuous expanding surface further comprises at least one flow surface fret.

7. The device of claim 1, wherein said flow from said fluid flow channel nominally retains its original cross-section dimension.

8. The method of claim 2, wherein said continuous expanding surface comprises a Coanda surface.

9. The method of claim 8, wherein said Coanda surface creates a reduced pressure region on the face of said Coanda surface.

10. The method of claim 2, wherein said continuous expanding surface comprises a convex surface.

11. The method of claim 2, wherein said flow from said fluid flow channel nominally retains its original cross-section dimension.

12. A method to directionally control a jet comprising:

providing a fluid flow channel having an input end and an output end;

flowing a jet through said fluid flow channel;

providing multiple control flow channels, located circumferentially around and adjacent to said fluid flow channel, each control flow channel having an input end and an output end;

providing a continuous expanding surface beginning immediately next to said output ends of each control flow channel;

wherein said output end of said flow channel merges with said output ends of each control flow channel at the beginning of said continuous expanding surface;

independently modulating flow in each of said control flow channels; and providing a control flow through at least one of said control flow channels on a side of a desired vectoring direction such that said control flow pulls said jet flow towards the flow exiting the at least one of said control flow channels.

13. The method of claim 12, wherein said continuous expanding surface comprises a Coanda surface.

14. The method of claim 12, herein said continuous expanding surface is a convex surface.

15. The method of claim 12, wherein said flow from said fluid flow channel follows a curved path.

16. The method of claim 12, wherein said jet nominally retains its original cross-section dimension.

17. The method of claim 12 further comprising providing commands from an automated system to independently modulate flow in each of said control flow channels.

18. The method of claim 12 further comprising modulating flow in each of said control flow channels to rotate said jet around the circumference of said fluid flow channel.

19. The method of claim 12 further comprising modulating flow in each of said control flow channels to increase the cross-section dimension of said jet flowing from said fluid flow channel.

20. The method of claim 12 further comprising modulating flow in each of said control flow channels to move said jet flowing from said fluid flow channel in a side-to-side profile.

* * * * *